US006625900B1

(12) United States Patent
Tobias

(10) Patent No.: US 6,625,900 B1
(45) Date of Patent: Sep. 30, 2003

(54) HEARING AID DRYING DEVICE

(76) Inventor: Stewart W. Tobias, 1611 18th Avenue Dr. East, Palmetto, FL (US) 34221-6503

( * ) Notice: Subject to any disclaimer, the term of this patent is extended or adjusted under 35 U.S.C. 154(b) by 0 days.

(21) Appl. No.: 10/047,652

(22) Filed: Jan. 14, 2002

(51) Int. Cl.[7] ..... F26B 19/00

(52) U.S. Cl. ..... 34/218; 34/218; 34/245; 34/220; 219/383; 219/385; 219/386; 219/400; 219/392; 219/521; 362/226; 362/249; 362/251; 362/253

(58) Field of Search ..... 34/218, 219, 220, 34/245; 219/383, 385, 386, 400, 392, 521; 362/226, 249, 251, 253

(56) References Cited

U.S. PATENT DOCUMENTS

| | | | | | |
|---|---|---|---|---|---|
| 4,372,068 | A | * | 2/1983 | Knapp et al. | 40/367 |
| 4,694,973 | A | * | 9/1987 | Rose et al. | 221/46 |
| 4,714,984 | A | * | 12/1987 | Spector | 362/101 |
| 4,816,973 | A | * | 3/1989 | Atalla et al. | 362/226 |
| 4,845,859 | A | * | 7/1989 | Evans | 34/107 |
| 5,004,894 | A | * | 4/1991 | Whitehead | 219/521 |
| 5,111,029 | A | * | 5/1992 | Grambush et al. | 219/521 |
| 5,171,087 | A | * | 12/1992 | Green | 362/226 |
| 5,517,264 | A | * | 5/1996 | Sutton | 353/119 |
| 5,640,783 | A | | 6/1997 | Schumaier | |
| 5,852,879 | A | | 12/1998 | Schumaier | |
| D414,304 | S | | 9/1999 | Schumaier | |
| 5,947,208 | A | * | 9/1999 | Ha | 169/51 |
| 6,362,460 | B1 | * | 3/2002 | Fraker | 219/438 |
| 6,390,647 | B1 | * | 5/2002 | Shaefer | 362/276 |
| 6,399,920 | B1 | * | 6/2002 | Guinn | 219/386 |
| D467,394 | S | * | 12/2002 | Schumaier | D32/1 |
| 6,561,673 | B2 | * | 5/2003 | Frederick | 362/234 |

* cited by examiner

*Primary Examiner*—Ira S. Lazarus
*Assistant Examiner*—Camtu Nguyen
(74) *Attorney, Agent, or Firm*—Charles J. Prescott

(57) ABSTRACT

A hearing aid drying device for receiving and heat-drying one or more hearing aids. The device includes an electrical outlet-supported and electrically actuated wall light having a base with electrical contacts for operative engagement into an electrical outlet and an electric light bulb operatively supported in the base. A support member is connected to the base and a container is connected to the support member in a position directly above and in close proximity to the light bulb. The container preferably includes a closeable lid and defines an interior volume adapted to receive at least one hearing aid placed therein whereby moisture in the hearing aid accumulated. during use thereof is heated sufficiently by the light bulb to cause the moisture to evaporate. Apertures formed through the lid and bottom of the container facilitate circulation of heated air through the interior volume.

8 Claims, 4 Drawing Sheets

HEARING AID DRYING DEVICE

BACKGROUND OF THE INVENTION

1. Scope of Invention

This invention relates generally to devices for drying and demoisturizing small items, and more particularly to a hearing aid drying device preferably in the form of a night light for economy, convenient access and placement of hearing aids therein during nighttime drying when the hearing aid is not in use.

2. Prior Art

During normal use of a hearing aid which is inserted into the ear canal, moisture and earwax accumulate on the interior surfaces of the hearing aid. This moisture and earwax can reduce the effectiveness of the hearing aid if not removed. Moreover, the presence of moisture can affect the longevity of the functioning of the hearing aid due to corrosion of the circuitry and battery contact surfaces of the hearing aid.

A hearing aid drying appliance is disclosed by Schumaier in U.S. Pat. No. 5,640,783. This appliance provides a housing with a removable cap that defines a sealed chamber into which the hearing aid or other small appliance is stored. A desiccant within the chamber defines two regions therein and a gas circulating means therethrough for effecting demoisturization.

In another patent by Schumaier, U.S. Pat. No. 5,852,879, discloses a variance of the drying appliance directed to the addition of a small fan for enhanced airflow through the device.

Yet another device by Schumaier is shown in U.S. Des. Pat. No. 414,304.

The present invention combines the simple and readily available structure of a night-light which is typically operated by insertion into an electrical wall outlet and a container held directly above the night light bulb by a support member which is preferably decorative in appearance. The container, preferably lidded, is sized to receive one or more hearing aids placed therein and, when the night light is operated for specific lengths of time, demoisturization and drying of the earwax build-up for easy brush removal is effected.

BRIEF SUMMARY OF THE INVENTION

This invention is directed to a hearing aid drying device for receiving and heat-drying one or more hearing aids. The device includes an electrical outlet-supported and electrically actuated wall light having a base with electrical contacts for operative engagement into an electrical outlet and an electric light bulb operatively supported in the base. A support member is connected to the base and a container is connected to the support member in a position directly above and in close proximity to the light bulb. The container preferably includes a closeable lid and defines an interior volume adapted to receive at least one hearing aid placed therein whereby moisture in the hearing aid accumulated during use thereof is heated sufficiently by the light bulb to cause the moisture to evaporate. Apertures formed through the lid and bottom of the container facilitate circulation of heated air through the interior volume.

It is therefore an object of this invention to provide a hearing aid drying device which will demoisturize one or more hearing aids which are stored in the device.

It is yet another object of this invention to provide a simplistic and economical structure for the drying or demoisturizing of hearing aids when they are not in use.

Still another object of this invention is to provide a hearing aid drying device in the form of an economical night light in combination with an openable container into which one or more hearing aids may be placed for nighttime demoisturizing and drying of built-up earwax.

In accordance with these and other objects which will become apparent hereinafter, the instant invention will now be described with reference to the accompanying drawings.

DETAILED DESCRIPTION OF THE INVENTION

Figure 1:
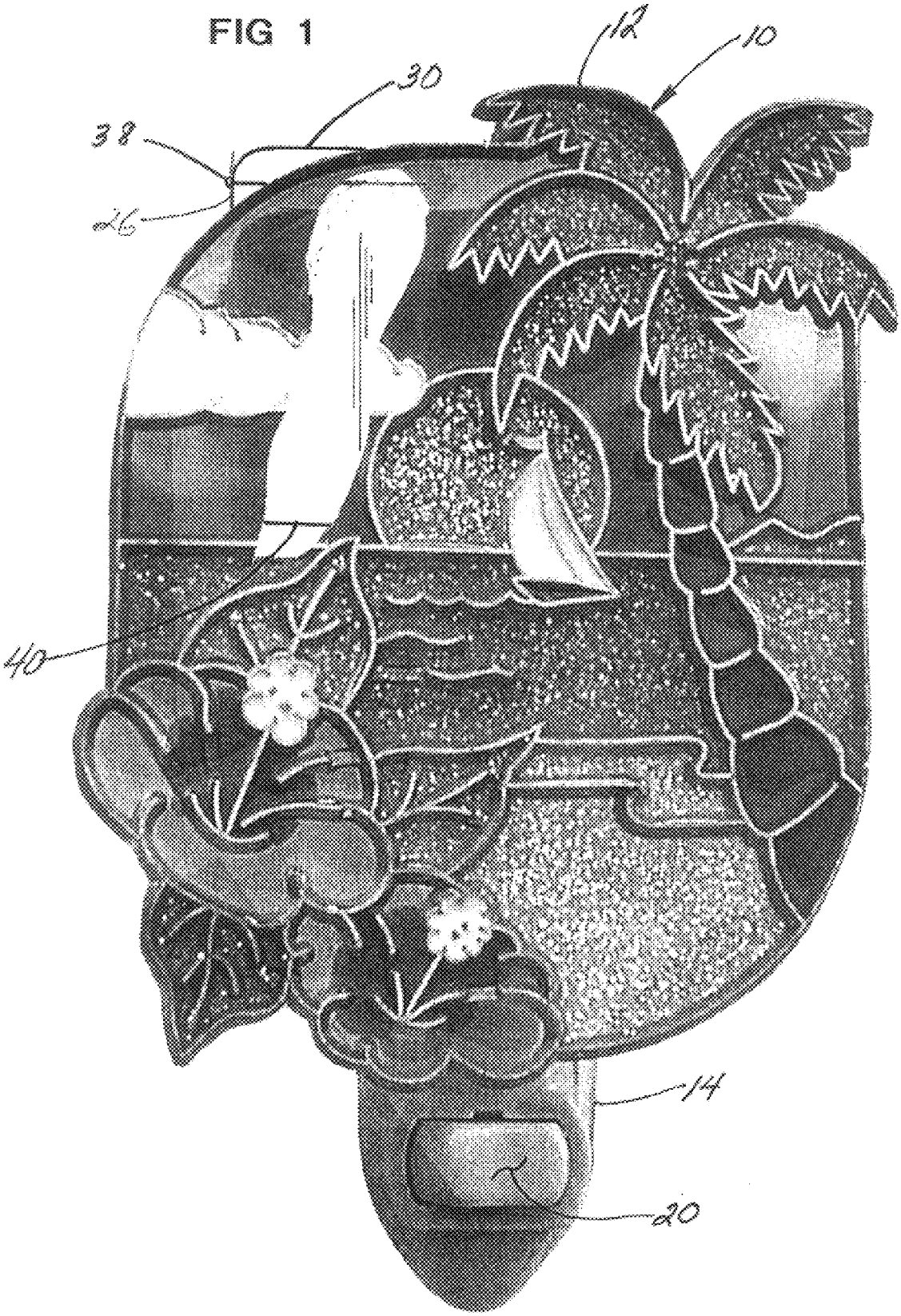
FIG. 1 is a front elevation partially broken view of the preferred embodiment of the invention.

Referring now to the drawings, the invention is generally shown at numeral 10 and includes an upright support member 12 which preferably includes a decorative front surface such as that best seen in FIG. 1. This support member 12 is attached at 24 to a support bracket 22 of an electrical base 14. The base 14 is structured having spaced electrical contacts 16 which are insertable into a conventional electrical wall outlet of a home or other electrically wired facility.

An incandescent light bulb 18 is operably positioned within an upwardly facing socket of the base 14. Preferably the light bulb 18 is of a low power output in the range of approximately four watts. At this power level, in conjunction with the structure of the base 14, the device 10 will serve as a night light as the preferred embodiment of this invention.

A container 26 formed as a unit of molded plastic material includes an upwardly facing opening which is closeable by a mating plastic lid 30. The lid 30 is hingedly connected to the upper margin of the opening of container 26 by a molded hinge 38 so that it will pivot in the direction of arrow A in FIG. 4 from a closed to an open position.

The interior 36 of container 26 is adapted in size to receive one or more hearing aids shown generally at H. These hearing aids H are of a type having a smaller portion insertable into the ear canal and a larger portion which houses the sound magnifying circuitry and battery of the hearing aid H. Typically, when such a hearing aid H is positioned for nighttime or non-use drying, the battery should be removed and the battery cavity left uncovered for more efficient demoisturization of the interior circuitry of the hearing aid H.

Figure 2:
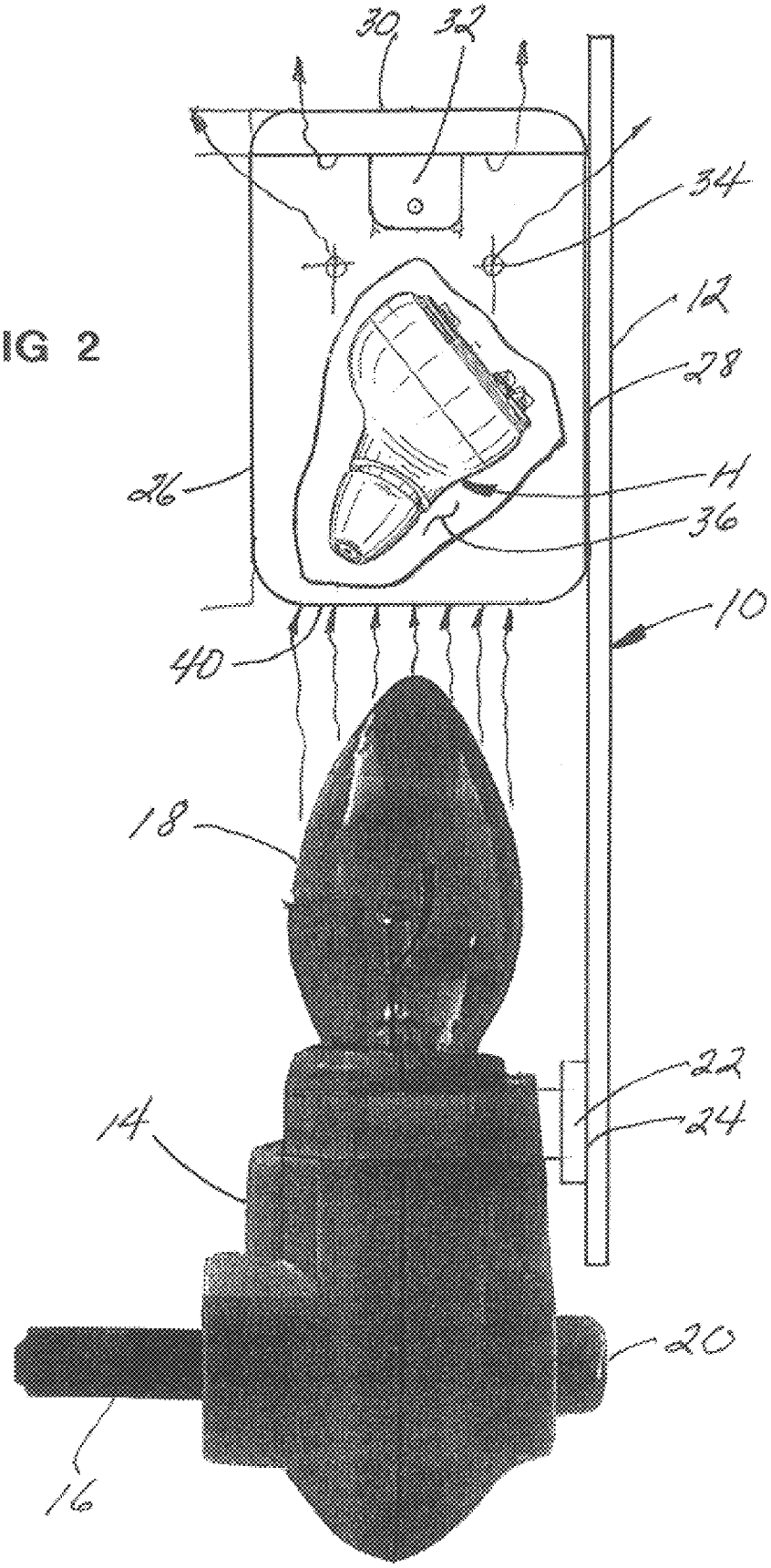
FIG. 2 is a side elevation partially broken view of FIG. 1.
Figure 3:
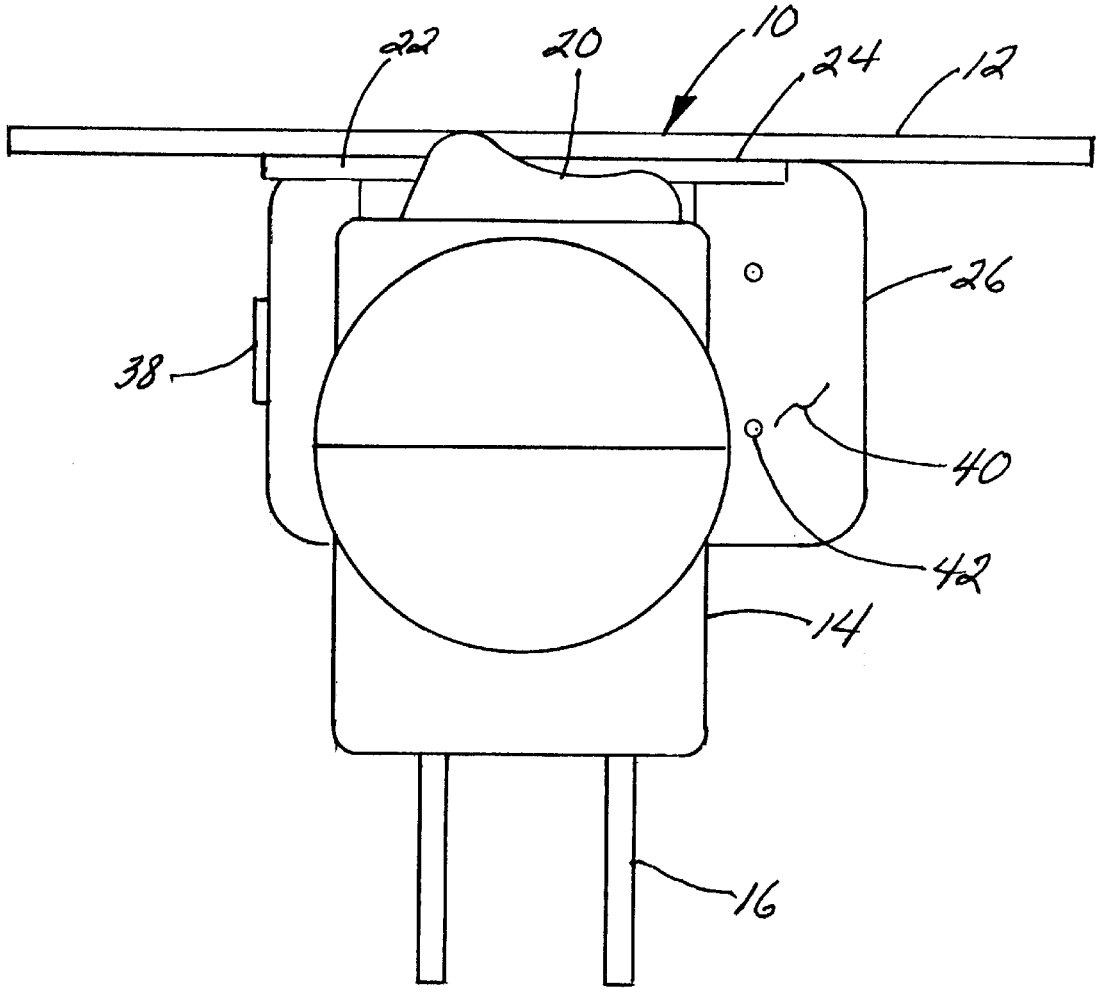
FIG. 3 is a bottom view of FIG. 1.
Figure 4:
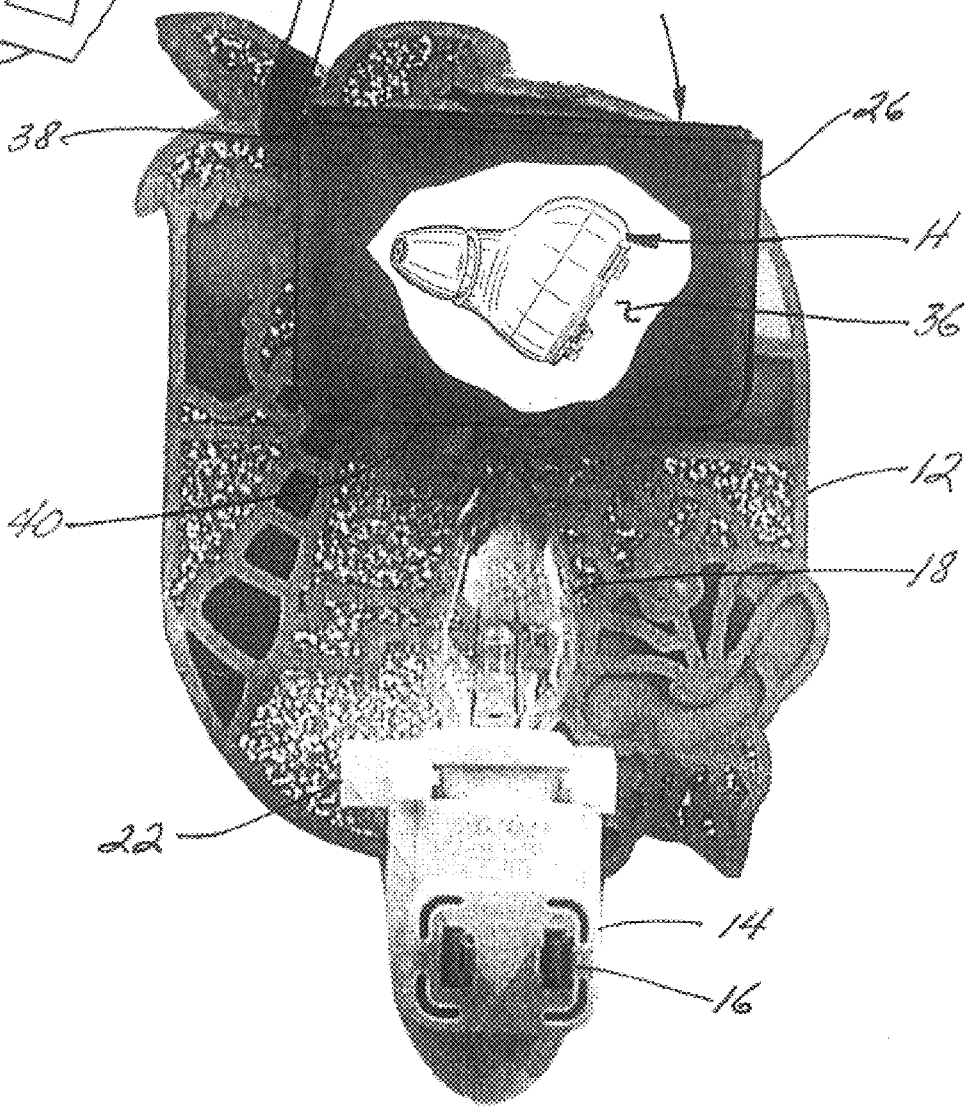
FIG. 4 is a rear elevation partially broken view of FIG. 1 showing the lid in an open position.

The container 26 as best seen in FIGS. 2 and 4 is positioned directly above, and in close proximity to, the light bulb 18 so that the heat emanating therefrom, when the device 10 is inserted into an electrical wall outlet and made operable by switch 20, will rise against the bottom 40 of the container 26 as shown in FIG. 2. The preferred embodiment includes apertures 42 formed through the bottom 40 as best seen in FIG. 3. These apertures 42 enhance the demoisturization of the hearing aid H and the drying of accumulated earwax by allowing the heated air to more efficiently flow through the interior volume 36. Apertures 34 in one or more of the upright side walls of container 26 further enhance the air flow through the interior volume 36.

Figure 5:
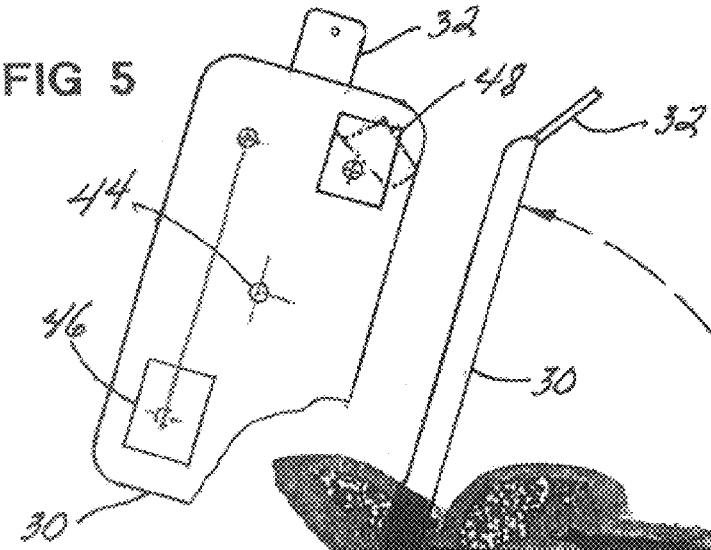
FIG. 5 is a plan view of the lid portion of FIG. 4.

As seen in FIG. 5, the closable lid 30 also contains a plurality of apertures 44 formed therethrough. As an addition to the preferred packaging of the invention 10 for marketing, one or more pieces of adhesive tape 46 and 48 are provided which allow the user to close off one or more of the apertures 44 for varying the temperature within the interior volume 36 and further to control the air flow therethrough. Ideally, an interior volume temperature in the range of 80° F. to 92° F. is preferred and has been found to be a very effective demoisturization temperature without causing any adverse effects to the plastic housing or electronic circuitry of the typically expensive and delicate hearing aid H.

The lid 30 is preferably held in place in its closed position by a small molded plastic latch 32 which engages over a mating post formed into the corresponding side wall of the container 26. In its preferred embodiment, the entire container 26, molded hinge 38, lid 30 and latch 32 are all molded as a single unit for manufacturing economy.

The container 26 is preferably attached to the inner or rearwardly facing surface of the support member 12 at 28 and should be of a relatively heat-resistant nature and include adhesive characteristics which will attach itself to the plastic side walls of the container 26 and the plastic and/or metal materials forming the support member 12. However, mechanical attachment is considered to be equivalent.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A hearing aid drying device comprising:

an electrical outlet-supported and electrically actuated wall light including a base with electrical contacts for direct supportive engagement into an electrical outlet and an electric light bulb operatively supported in said base;

a decorative support panel connected to and upwardly extending from said base;

a container having an openable lid connected to an inwardly facing surface of said support member in a position directly above said light bulb, said container and said lid defining a closable interior volume sized to receive a hearing aid placed therein whereby said interior volume is heated sufficiently by the light bulb to substantially demoisturize the hearing aid;

said lid including a plurality of apertures formed therethrough whereby heated airflow for demoistuzing the hearing aid is enhanced.

2. A hearing aid drying device as set forth in claim 1, further comprising:

tape means for closing at lest one of said apertures in said lid whereby the temperature within said interior volume may be selectively regulated.

3. A hearing aid drying device as set forth in claim 1, wherein:

said container has a bottom positioned in close proximity to said light bulb, said bottom having at least one aperture formed therethrough whereby more of the heat produced by and rising from said light bulb reaches said interior volume for demoisturizing the hearing aid.

4. A hearing aid drying device comprising:

an electrical outlet-supported and electrically actuated wall light of the type used as a night light including a base with electrical contacts for supportive operative engagement directly into an electrical outlet and a lower power electric light bulb operatively supported in said base;

a support member connected or connectable to said base and having a decorative surface facing away from said base;

a cup-shaped and sized container attached to a rear surface of said support member in a position above said light bulb, said container including a closeable lid defining an interior volume sized to receive one or a pair of hearing aids placed therein whereby moisture in the hearing aid and earwax accumulated during use thereof is heated sufficiently by the light bulb to cause the moisture to evaporate and for the wax to dry for easy removal;

said lid including a plurality of apertures formed therethrough whereby heated airflow for demoisturizing the hearing aid is enhanced.

5. A hearing aid drying device as set forth in claim 4, wherein:

said container has a bottom positioned in close proximity to said light bulb, said bottom having at least one aperture formed therethrough whereby more of the heat produced by and rising from said light bulb reaches said interior volume for demoistuizing the hearing aid.

6. A hearing aid drying device as set forth in claim 4, further comprising:

tape means for closing at lest one of said apertures in said lid whereby the temperature within said interior volume may be selectively regulated.

7. For drying accumulated moisture from a hearing aid, a hearing aid drying device comprising:

an electrical wall outlet-supported and electrically actuated wall light having spaced electrical contacts operably connectable directly into, and receiving full support from, a wall-mounted electrical outlet and inducing a base with electrical contacts for operative engagement into the electrical outlet and an electric light bulb operatively supported in said base;

a support member connected to said base;

a cup-shaped container connected to said support member in a position above said light bulb, said container defining an interior volume closely sized to receive one or a pair of hearing aids placed therein whereby moisture in the hearing aid accumulated during use thereof is heated sufficiently by the light bulb to cause the moisture to evaporate.

8. In an electrical wall outlet-supported and electrically actuated wall light of the type used as a night light including a base with electrical contacts for operative engagement directly into a wall-mounted electrical outlet and a lower power electric light bulb operatively supported in said base and having a support member connected or connectable to said base having a decorative surface facing away from said base, the improvement comprising:

a cup-shaped container attached to a rear surface of said support member in a position above said light bulb, said container including a closeable lid defining an interior volume closely sized to receive one or a pair of hearing aids placed therein whereby, when said light bulb is operated, moisture in the hearing aid and earwax accumulated during use thereof is heated sufficiently by the light bulb to cause the moisture to evaporate and for the wax to dry for easy removal.

* * * * *